US006413370B1

(12) United States Patent
Wurster et al.

(10) Patent No.: US 6,413,370 B1
(45) Date of Patent: Jul. 2, 2002

(54) ROLL PRINTING PAPER SUITABLE FOR COLD SET PRINTING AND PROCESS FOR ITS PRODUCTION

(75) Inventors: Hartmut Wurster, Friedberg; Hans-Peter Hofmann, Dachau, both of (DE)

(73) Assignee: Haindl Papier GmbH, Augsburg (DE)

( * ) Notice: Subject to any disclaimer, the term of this patent is extended or adjusted under 35 U.S.C. 154(b) by 0 days.

(21) Appl. No.: 09/634,874

(22) Filed: Aug. 7, 2000

Related U.S. Application Data

(63) Continuation-in-part of application No. 08/782,483, filed on Jan. 10, 1997.

(30) Foreign Application Priority Data

Jan. 16, 1996 (DE) ..... 196 01 245

(51) Int. Cl.[7] ..... D21H 19/38; D21H 19/58

(52) U.S. Cl. ..... 162/135; 162/158; 162/181.2; 162/181.4; 162/181.8; 162/175; 162/179; 428/341; 428/352; 427/361; 427/391; 427/177

(58) Field of Search ..... 162/135, 158, 162/162, 181.1–181.2, 181.8, 175, 169.179, 173, 181.4; 106/416, 455, 286.6, 903; 428/352–354, 219, 340–342, 393; 427/288, 361, 391, 177

(56) References Cited

U.S. PATENT DOCUMENTS

| | | | | | |
|---|---|---|---|---|---|
| 4,012,543 | A | * | 3/1977 | Ranger et al. | 427/361 |
| 4,284,546 | A | | 8/1981 | Delfosse et al. | |
| 4,298,652 | A | * | 11/1981 | Suzuki et al. | 428/323 |
| 4,301,210 | A | * | 11/1981 | Yasuda et al. | 428/342 |
| 4,820,554 | A | * | 4/1989 | Jones et al. | 427/391 |
| 5,017,268 | A | * | 5/1991 | Clitherow et al. | 162/146 |
| 5,423,911 | A | * | 6/1995 | Coutelle et al. | 106/416 |
| 5,698,305 | A | * | 12/1997 | Suzuki et al. | 428/219 |
| 5,753,077 | A | * | 5/1998 | Horand et al. | 162/135 |
| 5,858,076 | A | * | 1/1999 | Thompson | 106/217.3 |

FOREIGN PATENT DOCUMENTS

| | | | |
|---|---|---|---|
| EP | 0777014 A2 | | 6/1997 |
| WO | 95/27824 | * | 10/1995 |

OTHER PUBLICATIONS

Price et al., "Ultrafine Ground calcium Carbonate," Tappi May 1978 vol. 61, No. 5, pp 47–50.*

* cited by examiner

*Primary Examiner*—Jose Fortuna
(74) *Attorney, Agent, or Firm*—Smith, Gambrell & Russell, LLP

(57) ABSTRACT

A coated roll printing paper for printing with the cold-set offset-printing process is described, which gives a printing result comparable with that of low-weight coated matte grades. The paper is characterized by a high proportion of a fine calcium carbonate in the coating pigment, and a relatively low proportion of highly active binders.

29 Claims, No Drawings

ROLL PRINTING PAPER SUITABLE FOR COLD SET PRINTING AND PROCESS FOR ITS PRODUCTION

REFERENCE TO A RELATED APPLICATION

This application is a continuation-in-part of our co-pending application 08/782,483 filed Jan. 10, 1997, which is relied upon and incorporated herein by reference.

INTRODUCTION AND BACKGROUND

The invention concerns a coated roll printing paper which is suitable for printing with cold-set offset printing inks using a base paper as the carrier paper, which is formed from paper fiber material and mineral filler, with a coating containing calcium carbonate in the coating pigment, and with a synthetic binder as a binding agent. The invention further concerns the use of such a paper, and a process for its production.

At present, newspapers are nearly all printed by the offset process, using cold-set inks. In contrast to heat-set inks, cold-set inks need not be exposed to heat for drying. Instead, they dry as the water of the printing ink emulsion, as well as the oil in the ink, are absorbed into the carrier, i.e., the paper, as soon as possible, with the pigments of the ink remaining on the paper surface. Oxidative drying is also said to occur here.

Cold-set suitability according to the claimed invention demands a finished paper with hydrophilic properties and, consequently, a base paper with such properties. Thus, two factors are necessary in obtaining an acceptable printing quality using cold-set inks: a) a high and rapid printing ink penetration, and b) a rapid segregation of water and printing ink pigments in order to obtain a required rate of setting, or drying, of the printing ink.

Although print quality generally improves with increasing smoothness of the carrier, while the consumption of ink decreases, smoother papers are generally less absorbent, so that the absorption of the ink emulsifiers is slower. This causes smearing on the printing press guides and deposits in the folder and in the stack of copies. On the other hand, excess absorption causes the ink to penetrate more into the paper, giving an inadequate impression, i.e., poor dot separation and print-through of the print onto the back.

While standard newsprint meets the conditions for adequately rapid drying of cold-set inks, the quality of the image on newsprint is limited. Standard newsprint is an uncoated natural paper. Its pore volume is typically not covered by a coating, since such a coating would prevent absorption of the ink emulsion into the paper. It would be desirable, nonetheless, to modify such paper so as to improve its print quality for other uses, while maintaining the qualities necessary to process the paper in standard newspaper rotary presses. This is because rotary presses for newspapers are usually operated only during a limited portion of the day. It would be advantageous, then, to use such expensive equipment for other printing work, especially job printing, during the idle periods.

Such job printing, however, which may include brochure enclosures or the like, generally requires a higher quality printed image than is possible with standard newsprint. Because of that, there has been much discussion and experimentation with the goal of making improved papers which would be suitable for such applications. Such improved papers would ideally compare favorably with the quality of super-calendered (SC) papers, i.e., highly glazed papers such as are used for heat-set offset printing. As coated papers, they would also compare favorably with LWC (low weight coated) papers. Previous such experiments have not, however, been accepted in the marketplace.

European Patent Application 0 377 983 describes a coated newsprint paper in which suitability for cold-set use is said to be achieved by a certain minimum content of acicular or needle-shaped pigments in the coating pigment, and which is said to exhibit at least a certain oil absorption value. Acicular pigments, such as Satin White, precipitated calcium carbonate, and delaminated or structured kaolins, such as those recommended in the publication, are generally very expensive. Furthermore, because of their structure they require high usage of bonding material, which also increases the production costs. The claimed invention, however, obtains satisfactory results without the need for such acicular pigments.

Accordingly, it is an object of the invention to produce a coated paper which is suitable for printing with cold-set inks, which can be produced economically, which is visually distinguished from standard newsprint, and which can be processed at printing speeds such as those common in offset printing of newspapers, and on the machines intended for such printing.

SUMMARY OF THE INVENTION

In attaining the above and other objects, one feature of the invention is a coated roll print paper suitable for printing with the cold-set offset process, using base paper comprising paper fiber material and mineral filler as a carrier paper, and with a coating which contains a calcium carbonate in the coating pigment and a synthetic binding agent in the binder, wherein the calcium carbonate is typically a ground natural calcium carbonate, which makes up at least 50% by weight of the coating pigment. It will be understood that precipitated calcium carbonate can also be used instead of ground natural calcium carbonate.

Another feature of the invention is a method of making a coated roll print paper which is suitable for printing by the cold-set offset process. The method involves the use of base paper comprising paper fiber material and mineral filler as a carrier paper, which paper is suitable for printing by the cold-set offset process. While such paper has typically not met the needs of such high quality printing demands as printing brochure enclosures or the like, which generally require a higher quality printed image than is possible with standard newsprint, the claimed invention results in a paper suitable for printing by the cold-set offset process, but which is also suitable for such higher quality printing demands.

The method involves applying a coating which contains a calcium carbonate such as ground calcium carbonate in the coating pigment and a synthetic binding agent in the binder, wherein the calcium carbonate is advantageously a ground natural calcium carbonate, for purposes of economy, which makes up at least 50% by weight of the coating pigment. It will be understood, however, that precipitated calcium carbonate can also be used instead of ground natural calcium carbonate. The method according to the invention results in a coated paper which is perfectly suited to the cold-set offset printing process, and which can be processed at printing speeds such as those common in offset printing of newspapers, and on the machines intended for such printing.

A further feature of the claimed invention is providing an essentially unglazed or only very slightly glazed matte grade paper having Bekk smoothness values between about 10 and 50 seconds. Avoiding a high glaze on these papers allows a satisfactory picking resistance of the surface, which is necessary for printability, and also prevents a loss of the microcapillarity required for drying cold-set inks. A feature of the claimed invention is providing a paper having a suitable ink absorption, which is typically less than 1.1, and preferably less than 0.8.

A further feature of the invention is providing a paper having a contact angle measured with a FIBRO tester after 2 seconds which is <70°, and is preferably <55°. For purposes of comparison, standard newsprint has a value of only about 42° after 2 seconds. Such a natural paper has a high wettability.

According to the invention, the two paper properties mentioned above can partially balance each other. For instance, the invention contemplates excellent printing produced with a 2-second contact angle of 45° and an absorption, for both sides of the paper, of 0.5. Papers with contact angles of less than 50° and absorption values of less than 0.7 are considered outstandingly well suited for cold-set printing.

Another feature of the invention is that the total coating pigment has a fineness of at least 65% less than 2 μm, and the proportion of binder, as dry weight based on the coating pigment, is less than 15%, and preferably less than 13%.

A still further feature of the present invention resides in a process for producing a roll printing paper composition containing a paper fiber material and mineral filler, the base paper being coated with a coating color containing as the coating pigment a calcium carbonate, and as the binder a synthetic binder. The coating preparation used for the coating contains a coating pigment at least 50% by weight of which is a calcium carbonate, advantageously ground natural calcium carbonate, and the entire coating pigment of which has an average fineness of at least 65% less than 2 μm, and in which the proportion of binder, based on the coating pigment, is less than 15% by weight, and preferably less than 13%.

DETAILED DESCRIPTION OF THE INVENTION

It has been found, surprisingly, that a coated roll printing paper can be used with cold-set printing inks if the coating of the printing paper used has adequate microcapillarity and affinity for the emulsifiers of the cold-set printing inks. These properties can be attained if the coating pigment has a certain minimum proportion, namely 50%, of a calcium carbonate (not acicular), the overall fineness of the coating pigment being such that at least 65% by weight of the pigment is made up of particles having a size less than 2 μm, and the proportion of binder, based on the dry weight, less than 15% by weight of the coating pigment, and preferably less than 13%. Sufficiently fine grades of kaolin are known to give a high pigment porosity, but they require high usage of binders because of their high specific surfaces. This is particularly the case for delaminated and otherwise pretreated kaolins. Calcium carbonate, on the other hand, has an inert hydrophobic surface, requiring less binder in the coating.

Use of ground calcium carbonate in a coating is known from European Patent Application 0 377 983. There, though, the calcium carbonate is used only as a blending pigment along with the claimed acicular pigments.

According to the present invention, the calcium carbonate used should have medium to high fineness in order for the coating layer applied to have high microcapillarity to assure rapid drying of cold-set printing inks. The finer the capillaries, the higher the capillary pressure and thus the faster the phase separation of the printing inks, which are emulsified in more or less water. For high requirements, the coating pigment has 90 to 100% by weight of calcium carbonate with a fineness of at least 80% less than 2 μm, or at least 75% to about 85% by weight of a calcium carbonate with a fineness of about 90% less than 2 μm. The ink absorption time and, especially, the water absorption capability of the paper surface appear to be critical for satisfactory drying of the cold-set printing inks. This is discussed further herein.

To be sure, certain minimums should be maintained for both properties to get satisfactory printing, but one property can to a certain extent be compensated for by the other. The ink absorption time decreases with increasing fineness of the coating pigment, while the water absorption capability increases with increasing fineness of the coating pigment. At the same time, the specific surface of the pigment increases with the fineness, and thus the requirement for binder increases. This reduces the favorable print properties. The person skilled in the technology must thus find an optimal match between the fineness oft he coating pigment and the proportion of binder used.

Aluminum hydroxide is a particularly suitable blending pigment because of its morphology and fineness. It can be used in proportions up to about 20% by weight of the coating pigment. Otherwise, kaolin with a fineness of 65% or more less than 2 μm can also be used as a blending pigment, if the printability properties allow it. Talc, titanium dioxide and gypsum are also suitable blending pigments in small proportions, so long as they do not counteract the desired capillarity of the coating.

A sodium bentonite has also proved good as a blending pigment with high water absorption capacity. Up to 25% by weight of a grade having a specific surface of 600 $m^2/g$ can be used, limited by its effect on the rheology of the coating pigment.

It is desirable to use highly active binders in order that the cold-set suitability of the coating not be reduced by too much binder. The following types of binders are generally used for paper coating. They are listed here generally in order of decreasing binding action: polymeric dispersions (e.g., styrene-butadiene, acrylate, styrene-acrylate), polyvinyl alcohol, protein or casein, and starch. In order to get high binding action with the lowest possible proportion of binder, based on the coating pigment, polymeric binders and polyvinyl alcohol (PVA) are used preferably according to the invention. PVA has, along with its binding ability, the property of attaching irreversibly to surfaces having relatively inert reactivity, such as calcium carbonate. Therefore it is preferably used in combination with a plastic binder. According to the invention it is preferable to use less than 12% binder, based on the coating pigment and, if possible in the combination above, less than 9.5% by weight. Typically the proportion of binder used is actually only about 6.5% by weight. If starch is also used, the proportions of binder are near the upper limit. More or less hydrophilic binder, starch or CMC, (carboxymethyl cellulose), depending on the pigment mixture, is used with PVA to control the ink absorption time. It should be noted that, when developing a cold-set suitable paper, starch content of more than about 5% typically leads to delayed printing ink drying which is not acceptable, as it causes scaling in the printing press.

An example binder combination comprises 1.0 to 4.0 percent by weight PVA and 4.5 to 5.5 percent by weight of a synthetic binder, including but not limited to a butadiene-styrene binder or a styrene-acrylate binder. In the meaning of this description, the polymeric dispersions, also combined with PVA, are considered highly active binders. Addition of a cross-linking agent can be necessary for certain binders.

The coating pigments according to the invention can, for example, have the following typical components:

| | | |
|---|---|---|
| $CaCO_3$ | 65% <2 μm | 50–100% |
| $CaCO_3$ | 90% <2 μm | 50–90% |
| Kaolin | 65% <2 μm | 0–50% |
| Kaolin | 80% <2 μm | 0–50% |
| $Al(OH)_3$ | 98% <2 μm | 0–20% |
| Sodium bentonite | 600 $m^2/g$ | 0–25% |
| Polymeric binder | | 3–10% |
| PVA | | 0–5% |
| Protein | | 0–5% |
| Starch | | 0–5% |

The coating pigments used can also contain the usual additives, such as up to about 1.5% by weight melamine-formaldehyde resin as a wet-strength agent, up to about 0.4% carboxymethyl-cellulose (CMC) as a solution, optical brighteners, and/or chemicals for pH adjustment, such as NaOH.

Ground natural calcium carbonates which are suitable for the invention and which are commercially available in large quantities include, for instance, Types C60 HS, C 70 and C90 HS from ECC International. The C60 HS grade has a proportion of 63±3% by weight less than 2 μm with not more than 2% by weight greater than 10 μm and not more than 0.01% by weight greater than 45 μm. The C90 grade contains 90±3% by weight less than 2 μm, not more than 1% by weight greater than 10 μm, and not more than 0.01% by weight greater than 45 μm. These grades are provided as slurries with solids contents of 78±1% by weight. Omya is another producer of suitable grades of calcium carbonate.

The coating pigments according to the invention are processed in an aqueous slurry with solid contents of 30–65% by weight based on dry weight. Applicable coating processes include doctor blade coating processes such as the inverted blade, jet flow, roll-coating systems such as the Massey coater, film presses such as the Jagenberg film press, the Speedsizer or the Metering Size Press from Beloit. As is well known, doctor blade coating processes smooth the paper surface, giving a coating thickness that varies with location, while roll-coating systems give a more even coating thickness which can be advantageous for ink absorption under some circumstances. Gentle drying of the coating can also be important so that undesirable migration of binder does not injure the desired evenly distributed microcapillarity of the coating.

The invention contemplates coating weights for singly coated papers as a weight of more than 4 $g/m^2$ for each side on the base paper. Coating weights of 7–12 $g/m^2$ per side, typically about 8 $g/m^2$ per side, are preferred.

The invention is not, however, limited to singly coated papers. It is also applicable to double-coated papers. Double coatings have coating weights per unit area of at least 15 $g/m^2$ per side, and typically 20 $g/m^2$ per side, with the coating weight divided about equally between the two coatings. The top coat is critical for the properties of the paper according to the invention. If the present description speaks of a coating without specifying exactly, it means the single coating for singly coated papers, and, generally, the top coating of doubly coated papers; but in separate definitions it means the total coating.

In the present description, the first coat of a double coat is always expressly called the first coat.

The top coat is largely critical for the properties of a double-coated paper according to the invention. Thus it must meet the requirements and conditions which were described above essentially with respect to application to singly coated papers. The first coat does not absolutely have to have the same fineness or microcapillarity as the preferred embodiments of the previously described coatings. But even the first coat should contain at least 50% by weight of calcium carbonate such as ground natural calcium carbonate, and it should also meet the requirements of the total coating pigment having a fineness of at least 65% less than 2 μm, and the proportion of binder as dry weight, based on the coating pigment, of less than 15%, preferably less than 13%.

The minimum requirements as stated above are valid for purposes of definition both for singly and doubly coated papers. This is even more the case to the extent that a top coat which represents a preferred embodiment in its composition and fineness exceeds the minimum requirements set forth herein, when the first coat, considered by itself, does not absolutely have to meet these minimum requirements.

It may be practical to pre-smooth the base paper before applying the single coating or the first coating, as in a smoothing machine at the end of the paper machine, which can also be equipped with a 'Soft-Nip'.

A variety of base papers can be used according to the invention. Both papers with and without mechanical wood can be used, as well as those with a substantial proportion of recycled paper fiber. For instance, a mechanical-wood-free base paper from raw materials in the proportions (as dry weight) of about 78% chemical pulp; about 20% mineral filler, made up of 15% calcium carbonate, 2.5% kaolin and 2.5% talc; and about 1% starch and about 1% other additives is suitable.

For cost reasons, however, paper containing mechanical wood pulp and a proportion of recycled wastepaper is preferred. As a rule, too, base papers containing mechanical wood pulp have advantages for printing, such as higher opacity. The fiber content of a base paper containing mechanical wood pulp and wastepaper, based on total fiber, as dry material, can be about 20% chemical pulp, 20% mechanical pulp, and 60% wastepaper. The material can also contain up to about 50% mineral filler, based on the fiber content, so that the filler is about ⅓ of the material. As is well known, this proportion of filler does not entirely remain in the paper; some gets into the wastewater.

When mechanical wood fibers are mentioned in this description as fiber components, the term applies to all the materials which are usually meant by that term in paper technology, such as groundwood pulp, thermomechanical pulp (TMP), chemothermomechanical pulp (CTMP), etc.

Another factor which is important in obtaining acceptable printing with cold-set inks, along with satisfactory ink drying, is the dimensional stability of the paper. As the water from cold-set inks penetrates not only into the coating but also into the base paper, this affects the bonding between fibers and the dimensional stability of the paper. This effect is greater than with normal newsprint. When a coated paper having a weight per unit area comparable with the coating is used as a carrier for the coating, the paper makes up a correspondingly smaller proportion by weight. That is, the base paper is thinner. The dimensional stability of a paper exposed to moisture can be improved by additives, such as starch. Thus it is common to add about 0.5% starch to the material going into the base paper. Papers made on an open Fourdrinier machine or on the "hybrid formers," in which the upper dewatering screen accompanies the Fourdrinier screen only after the sheet has been formed, may perhaps have adequate dimensional stability for use in cold-set printing without addition of starch to the paper. Because of the production process, they have relatively favorable fiber orientation with transverse to longitudinal ratios of about 1:2 to a maximum of about 1:2.5. As the fibers are oriented principally in the production direction, i.e., the long direction of the paper, the deficiency in dimensional stability appears essentially in transverse shrinkage, which is increased by the tension of the paper in the printing machine.

Currently, papers for large-scale printing are produced only on very high-speed Fourdrinier machines, which, at the present state of the technology, use so-called "Gap Formers", in which the sheet is formed in the running gap between two screens. Papers made on such modern machines have substantially poorer transverse/longitudinal fiber orientation, in the range of about 1:3 to 1:4. That causes such papers to have considerably poorer transverse stability.

Now, as part of the invention, it has been found that the dimensional stability of papers produced on gap formers can be improved adequately by adding more than 1% starch, up to a maximum of 2%, and typically about 1.5%, to the input materials. The surprising feature is not the effect of the starch on the paper, but the fact that paper with such a high starch content can be produced at all on a gap former. This had not been considered possible. It has been made possible, as part of the invention, with a modified, highly cationic, starch. The surprising effect was that when 1.5% starch was added to the input materials, about 1.4% could be found in the base paper, indicating an astonishingly high retention of the starch in sheet formation. Higher proportions of starch in the input do not have a significant effect on the base paper and, at best, increase the wastewater loading and costs. In a test run with highly cationic starch, the base paper could be produced without reducing the machine speed, at about 1220 meters/minute.

With respect to suitability of a paper for cold-set ink printing, extensive studies were done to determine which measurable paper characteristics determine the suitability of the paper. It was found that certain limits in ink absorption and, particularly, in the surface wettability, are critical. A modified absorption test is used in the inventor's company to determine the ink absorption. It uses the multipurpose test printer, Dr. Durner System, from the company "Prüfbau Dr. Ing. Herbert Dürner" in Peisenberg. The surface wettability is generally determined by the time-dependent decrease in contact angle of a liquid drop placed on the surface. The FIBRO 1100 Dynamic Absorption Tester from FIBRO-System AB in Stockholm was used for that. Summaries of the test procedures are set forth below in Test Summaries A and B.

In the absorption test, a proof print is made with a standard printing ink under defined conditions. After a specified period it is pressed together with a backing paper. The ink intensity transferred to the backing paper is measured with a densitometer. The data below show the densitometer values for the backing paper after 30 seconds.

Distilled water was used in the contact angle measurements to determine surface wettability. The contact angles measured with the FIBRO tester after 2 seconds are reported below.

It has been determined that the ink absorption is important for suitability for the cold-set printing process. It should be less than 1.1, and preferably less than 0.8. The contact angle measured with the FIBRO tester after 2 seconds should be <70° and preferably <55°. For example, standard newsprint has a value of only about 42° after 2 seconds. Such a natural paper has a high wettability.

It should be noted that the two paper properties mentioned above can partially balance each other. For instance, excellent printing is produced with a 2-second contact angle of 45° and an absorption, for both sides of the paper, of 0.5. Papers with contact angles of less than 50° and absorption values of less than 0.7 are considered outstandingly well suited for cold-set printing.

The papers according to the invention, which have the properties stated above, are essentially unglazed or only very slightly glazed papers with Bekk smoothness values between about 10 and 50 seconds. These are matte grades. A high glaze on papers according to the invention would not only reduce the picking resistance of the surface, which is required for printability, but might also result in loss of the microcapillarity required for drying the cold-set inks.

If not otherwise specified in this description, percentages are weight percentages. Also, if not specifically stated otherwise, the percentages and other quantities refer to the components considered as dry. In this relation, the term "otro" refers to the oven-dry state.

Example embodiments of the invention follow.

EXAMPLE 1

The following raw materials were used to produce base paper on a high-speed Fourdrinier machine with a double-screen former (gap former) at a machine speed of about 1200 meters/ minute:

| | Base paper raw materials |
|---|---|
| Groundwood | 12.3% |
| Chemical pulp | 13.0% |
| Wastepaper | 40.0% |
| Filler | 33.0% |
| Highly cationic starch | 1.5% |
| Retention agent | 0.2% |
| | **Base paper test data** |
| Weight per unit area | 40.3 g/m$^2$ |
| Proportion of filler | 15.2% |
| Longitudinal breaking stress | 41.8 N |
| Transverse breaking stress | 11.8 N |
| Fiber orientation, transverse/longitudinal | 1:3.5 |
| Brightness | 73.5% |
| Volume | 1.538 cm$^3$/g |

EXAMPLE 2

The base paper made according to Example 1 was coated with a coating having the following composition:

| | |
|---|---|
| Natural $CaCO_3$, 95% <2 $\mu$m | 80% |
| $Al(OH)_3$, 98% <2 $\mu$m | 20% |
| | 100% |

| Binders and additives, based on the coating pigments | |
|---|---|
| Styrene-acrylate binder | 10% |
| Starch solution | 3% |
| CMC (carboxymethyl cellulose) solution | 0.25% |
| Melamine-formaldehyde resin | 0.8% |
| Optical brightener | 1.3% |

The coating had a weight per unit area of about 8 g/m$^2$ per side. The following measurements were made on the finished paper:

| | |
|---|---|
| Weight per unit area | 56.5 g/m$^2$ |
| Ash on ignition at 6000C | 35.3% |
| Volume | 1.18 cm$^3$/g |
| Bekk smoothness, upper side | 22 seconds |
| Bekk smoothness, lower side | 15 seconds |
| 2-second contact angle, FIBRO test 58° | |
| Absorption at 30 seconds | 0.42 |

The cold-set suitability, i.e., adequate ink drying of this paper in the practical test, was satisfactory.

EXAMPLE 3

The base paper according to Example 1 was coated with a coating having the following composition:

| Coating pigment | |
|---|---|
| Natural $CaCO_3$, 90% <2 μm | 100% |

| Binders and additives based on the coating pigment | |
|---|---|
| Butadiene-styrene binder | 5.0% |
| PVA solution | 3.5% |
| Melamine-formaldehyde resin | 1.3% |
| Optical brightener | 1.3% |
| The paper had the following surface characteristics: | |
| 2-second contact angle, FIBRO test | 45° |
| Absorption value after 30 seconds | 0.50 |

The other test data are the same as for the paper of Example 2. The paper made in this example showed outstanding cold-set suitability in the practical test.

EXAMPLE 4

The base paper made as in Example 1 was coated with a coating pigment which differed from that of Example 3 only in the fact that, instead of a polyacrylate dispersing agent, the pigment was made into a cationic pigment slurry with a high-amine-content cationic dispersing agent, and a cationic polymeric binder was used to prepare the coating pigment. The finished paper had the following surface characteristics:

| | |
|---|---|
| 2-second FIBRO contact angle | 50° |
| Absorption after 30 seconds | 0.39/0.47 |

The printability of this paper in the cold-set process was also very good.

EXAMPLE 5 (Comparison example)

The base paper made as in Example 1 was coated with a coating pigment having the following composition:

| | |
|---|---|
| Natural $CaCO_3$, 90% <2 μm | 80% |
| Kaolin, 80% <2 μm | 20% |
| | 100% |

Binders and additives, based on the coating pigment

| | |
|---|---|
| Styrene-acrylate binder | 9.5% |
| Starch solution | 7.0% |
| CMC solution | 0.25% |
| Melamine-formaldehyde resin | 0.8% |
| Optical brightener | 1.3% |

The paper coated with this coating pigment had the following surface properties:

| | |
|---|---|
| 2-second FIBRO contact angle | 72° |
| Absorption after 30 seconds | 1.11/1.19 |

Ink drying on printing with cold-set inks was not satisfactory. This can be determined already by the surface properties, and was likely due to the high proportion of binder.

A paper with a pigment coating differing from that above only in having 20% $Al(OH)_3$, 98% <2 μm, instead of 20% kaolin in the coating pigment gave similarly poor print results. The composition and proportion of binder were the same.

The papers made as in Examples 3 and 4 could be processed on cold-set printing presses at the usual production rates, and gave accurate image reproduction with normal ink drying. At the same time, the ink consumption was less than for newsprint. Water usage was reduced. The higher whiteness, compared with normal newsprint, gave a more contrasty print that was quite comparable with that of low-weight-coated (LWC) matte grades.

Test Summary A

FIBRO 1100 DAT is the name of an instrument from Fibro system AB, Box 9081, S-12609 Stockholm, Sweden. The letters DAT stand for "Dynamic Absorption Tester". The instrument is used to measure surface wettability. This is a paper characteristic which must be accurately measured and adjusted for processes such as coating, printing, etc. It works on the principle of contact angle measurement, and is based on a method developed by the Swedish Paper Research Institute.

The instrument comprises a medical dropper system and a CCD (charge-coupled device) camera; the drop size is adjustable from 0.1 to 9.9 μl and changes in the drop deposited on the paper sample, which are characteristic for the wettability, can be documented in storable video images with a cycle time of 20 milliseconds. The change of the contact angle with time can be plotted, so that the wettabilities of different paper samples can easily be compared with each other.

In this instance, distilled water was used for wetting, and the wetting was determined after 2 seconds.

Test Summary B

In the counter-pressure test, also called a smear test or absorption test, a specified quantity of printing ink is placed on a paper strip. Sections of the strip are then rolled on backing paper strips at specified time intervals. The quantities of ink transferred to the backing paper strips is determined optically. They allow conclusions about the ink absorption and stackability of the sample strips.

Details of the test procedure can be found in a detailed description of multipurpose test printing presses from Prüfbau, Dr. Ing. Herbert Dürner, Aich 17-23, D-82380 Peissenberg/Munich, dated Sep. 26, 1972. See, in particular, FIGS. 10.5 and 14.2.

The instructions recommend 0.3 $cm^3$ ink for coated papers, an ink-distribution time of 30 seconds in the ink distributing rollers, and 30 seconds for the printing form. The pressure for printing and counter-pressure should both be 200 N/cm, i.e., 800 N for printing form width of 4 cm. The absorption test No. 52 0068 of the Michael Huber Ink Factory, Munich, should be used. The counterpressure should be applied after 30, 60, 120 and 240 seconds. The recommended press speed is 0.5 m/second. A standard paper called APCO II/II from the Scheufelen company is used as the test printing paper.

In this instance, the test was done with the values stated, but with twice the printing speed. The ink transfer to the baking strips caused by counterpressure for 30 seconds, was evaluated in particular.

Further variations and modifications of the foregoing will be apparent to those skilled in the art and are intended to be encompassed by the claims which follow.

German priority application 196 01 245.7 is relied upon and incorporated herein by reference in its entirety. U.S. Pat. Appln. No. 08/782,483, the parent application on which the present continuation-in-part application is based, is likewise relied upon and incorporated herein by reference in its entirety.

We claim:

1. A coated roll print paper suitable for printing with a cold-set offset process, comprising:

a base paper containing a paper fiber material; and a coating composition, formed on said base paper, containing a coating pigment, and a binder, wherein said paper is machine-smooth or glazed, having smoothness, according to Bekk, between 10 and 50 seconds, and wherein said coating pigment comprises calcium carbonate, wherein said paper is machine-smooth or glazed, having a smoothness, according to Bekk, between 10 and 50 seconds, and wherein an ink absorption test gives a value less than 1.1.

2. The coated roll print paper according to claim 1, wherein a surface wettability of the coated paper determined as a contact angle according to a Fibro test gives a value of less than 70° after 2 seconds.

3. The coated roll print paper according to claim 2, wherein the contact angle gives a value of less than 55° after 2 seconds.

4. The coated roll print paper according to claim 1, wherein the base paper further comprises a mineral filler.

5. The coated roll print paper according to claim 4, wherein the base paper contains no more than 18% by weight mineral filler, based on oven-dried paper fiber.

6. The coated roll print paper according to claim 1, wherein said binder comprises, in percent by dry weight of the coating pigment:

3–10% synthetic binder;

0–5% polyvinyl alcohol (PVA);

0–5% protein; and

0–5% starch.

7. The coated roll print paper according to claim 6, wherein said protein comprises casein.

8. The coated roll print paper according to claim 1, wherein said coating pigment further comprises at least one additional pigment.

9. The coated roll print paper according to claim 8, wherein said additional pigment is at least one member selected from the group consisting of aluminum hydroxide, kaolin, talc, titanium dioxide, gypsum, and sodium bentonite.

10. The coated roll print paper according to claim 9, wherein said coating pigment contains up to 20% by weight of an aluminum hydroxide having a fineness of at least 95% less than 2 $\mu$m.

11. The coated roll print paper according to claim 9, wherein said coating pigment satisfies at least one condition selected from the group consisting of:

a proportion of up to 50% by weight kaolin having a fineness wherein at least 65% by weight are less than 2 $\mu$m;

a proportion of up to 20% by weight aluminum hydroxide having a fineness of 95% less than 2 $\mu$m; and a proportion of 25% by weight of a sodium bentonite.

12. The coated roll print paper according to claim 9, wherein said coating pigment contains 20% by weight of an aluminum hydroxide having a fineness of at least 95% less than 2 $\mu$m.

13. The coated roll print paper according to claim 1, wherein a weight per unit area of the coating is at least 5 $g/m^2$ per side.

14. The coated roll print paper according to claim 1, wherein a weight per unit area of the coating is from 7–12 $g/m^2$ per side.

15. The coated roll print paper according to claim 1, wherein a weight per unit area of the coating is at least 15 $g/m^2$ per side.

16. The coated roll print paper according to claim 15, wherein said weight per unit area of the coating is 20 $g/m^2$ per side.

17. The coated roll print paper according to claim 1, wherein the base paper further comprises at least 1.0% by weight of cationic starch.

18. The coated roll print paper according to claim 17, wherein the highly cationic starch is present in an amount of at least 1.3%.

19. The coated roll print paper according to claim 1, wherein said calcium carbonate makes up at least 50% by weight of the coating pigment;

wherein said coating pigment has a fineness of at least 65% less than 2 $\mu$m; and wherein a proportion of binder based on coating pigment is less than 15% based on dry weight.

20. The coated roll print paper according to claim 19, wherein the coating pigment comprises 50 to 60% by weight of calcium carbonate having a fineness of at least 60% less than 2 μm, with the remainder of said pigment having an average fineness of at least 80% less than 2 μm.

21. The coated roll print paper according to claim 19, wherein an average fineness of the coating pigment is at least 80% less than 2 μm.

22. The coated roll print paper according to claim 19, wherein the proportion of binder, based on the coating pigment, is less than 12% by weight.

23. The coated roll print paper according to claim 22, wherein said proportion of binder based on the coating pigment is less than 9.5% by weight.

24. The coated roll print paper according to claim 22 wherein the binder, as a percentage of the coating pigment, comprises:

1.0 to 4.0% by weight PVA; and 4.5 to 5.5% by weight of a t least one synthetic binder selected from the group consisting of a butadiene-styrene binder and a styrene-acrylate binder.

25. The coated roll print paper according to claim 1, wherein the ink absorption test gives a value of less than or equal to 0.8.

26. The coated roll print paper according to claim 1, wherein said calcium carbonate is not in acicular form.

27. A method of producing a coated roll print paper suitable for printing with a cold-set offset process, comprising:

providing a base paper containing a paper fiber material, and coating the base paper with a coating composition comprising:

a coating pigment comprising calcium carbonate, and a binder, wherein the paper obtains a value in an ink absorption test of less than 1.1.

28. The method of producing a coated roll print paper according to claim 27, wherein the base paper further comprises a mineral filler.

29. The method of producing a coated roll print paper according to claim 27, wherein a surface wettability of the resulting coated paper determined as a contact angle according to a Fibro test gives a value of less than 70° after 2 seconds.

* * * * *